US011078036B2

(12) United States Patent
Nakano et al.

(10) Patent No.: US 11,078,036 B2
(45) Date of Patent: Aug. 3, 2021

(54) SHEET CONVEYOR AND IMAGE FORMING APPARATUS

(71) Applicant: Brother Kogyo Kabushiki Kaisha, Nagoya (JP)

(72) Inventors: Hiroshi Nakano, Nagoya (JP); Takashi Arakawa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 101 days.

(21) Appl. No.: 16/357,586

(22) Filed: Mar. 19, 2019

(65) Prior Publication Data

US 2019/0291989 A1 Sep. 26, 2019

(51) Int. Cl.

| | |
|---|---|
| ***B65H 3/52*** | (2006.01) |
| ***B65H 5/06*** | (2006.01) |
| ***B65H 3/06*** | (2006.01) |

(52) U.S. Cl.

CPC ..... *B65H 5/062* (2013.01); *B65H 3/0669* (2013.01); *B65H 3/5261* (2013.01); *B65H 3/5284* (2013.01); *B65H 2515/32* (2013.01)

(58) Field of Classification Search

CPC ..... B65H 3/5261; B65H 3/5284; B65H 2403/732; B65H 3/0669; B65H 2515/32; B65H 2515/322; B65H 5/062

See application file for complete search history.

(56) References Cited

U.S. PATENT DOCUMENTS

| | | | | |
|---|---|---|---|---|
| 6,913,257 | B2 * | 7/2005 | Takaki | H04N 1/00909 271/10.13 |
| 8,678,372 | B2 | 3/2014 | Yasukawa | |
| 8,777,212 | B2 | 7/2014 | Yasukawa | |
| 2013/0241144 | A1 | 9/2013 | Yasukawa | |
| 2013/0241145 | A1 | 9/2013 | Yasukawa | |
| 2014/0167346 | A1 * | 6/2014 | Iijima | B65H 85/00 271/3.15 |
| 2019/0233230 | A1 * | 8/2019 | Ichikawa | B65H 3/5284 |

FOREIGN PATENT DOCUMENTS

| | | | |
|---|---|---|---|
| JP | 2010-208757 A | | 9/2010 |
| JP | 2013-193837 A | | 9/2013 |
| JP | 2013-193838 A | | 9/2013 |
| JP | 2013180894 A | * | 9/2013 |
| JP | 2014-136641 A | | 7/2014 |

* cited by examiner

*Primary Examiner* — Luis A Gonzalez

(74) *Attorney, Agent, or Firm* — Banner & Witcoff, Ltd.

(57) ABSTRACT

A sheet conveyor includes a drive roller, a retard roller forming a nip with the drive roller, a first torque limiter disposed coaxially with the retard roller and communicating with the retard roller, a first gear disposed coaxially with the retard roller, a drive train including a plurality of gears for receiving a driving force from the first gear, a second torque limiter, and an arm member including a contact portion located downstream of the drive roller in the conveyance direction. The arm member is movable between a first arm position to allow transmission of the driving force to the second torque limiter and a second arm position to interrupt transmission of the driving force to the second torque limiter. The arm member is configured to, as the sheet conveyed by the drive roller contacts the contact portion, move from the first arm position to the second arm position.

6 Claims, 8 Drawing Sheets

SHEET CONVEYOR AND IMAGE FORMING APPARATUS

CROSS-REFERENCE TO RELATED APPLICATION

This application claims priority from Japanese Patent Application No. 2018-054915 filed on Mar. 22, 2018, the content of which is incorporated herein by reference in its entirety.

FIELD OF DISCLOSURE

Aspects described herein relate to a sheet conveyor and an image forming apparatus.

BACKGROUND

A known sheet conveyor includes a mechanism to separate multi-fed sheets one by one and convey a single sheet. The sheet conveyor may be mounted in an image reading apparatus, an image forming apparatus, a copier, or other apparatus. In one example, the sheet conveyor includes a retard roller used with two torque limiters to improve the ability to separate multi-fed sheets.

The sheet conveyor changes an amount of load applied to the retard roller by using an electromagnetic clutch to switch two torque limiters. By changing the amount of the load applied to the retard roller, the sheet conveyor reduces a conveyance resistance to a separated sheet while maintaining the ability to separate sheets.

SUMMARY

However, the use of an electromagnetic clutch to change the amount of the load applied to the retard roller may lead to complicated structures and increased physical size of the sheet conveyor, thus resulting in increased costs.

Illustrative aspects described herein provide a sheet conveyor including a retard roller and torque limiters and having a simple structure to change an amount of load applied to the retard roller, and provide an image forming apparatus including the sheet conveyor.

According to an aspect described herein, a sheet conveyor includes a drive roller configured to convey a sheet in a conveyance direction, a retard roller forming a nip with the drive roller, a first torque limiter disposed coaxially with the retard roller and communicating with the retard roller, a first gear disposed coaxially with the retard roller, a drive train including a plurality of gears for receiving a driving force from the first gear, a second torque limiter disposed in the drive train, and an arm member including a contact portion located downstream of the drive roller in the conveyance direction. The arm member is movable between a first arm position to allow transmission of the driving force to the second torque limiter and a second arm position to interrupt transmission of the driving force to the second torque limiter. The arm member is configured to, as the sheet conveyed by the drive roller contacts the contact portion, move from the first arm position to the second arm position While a separated sheet is conveyed, the arm member is at the second arm position, and an amount of load applied to the retard roller, which will be a conveyance resistance to the sheet, is reduced. Thus, the sheet conveyor switches an amount of load applied to the retard roller, simply using the arm member that is mechanical in structure, instead of using an electrical structure, for example, an electromagnetic clutch. Thus, the sheet conveyor using the mechanically structured arm member can be produced at a lower cost and in a smaller size than a sheet conveyor using an electromagnetic clutch.

DETAILED DESCRIPTION

Figure 1:
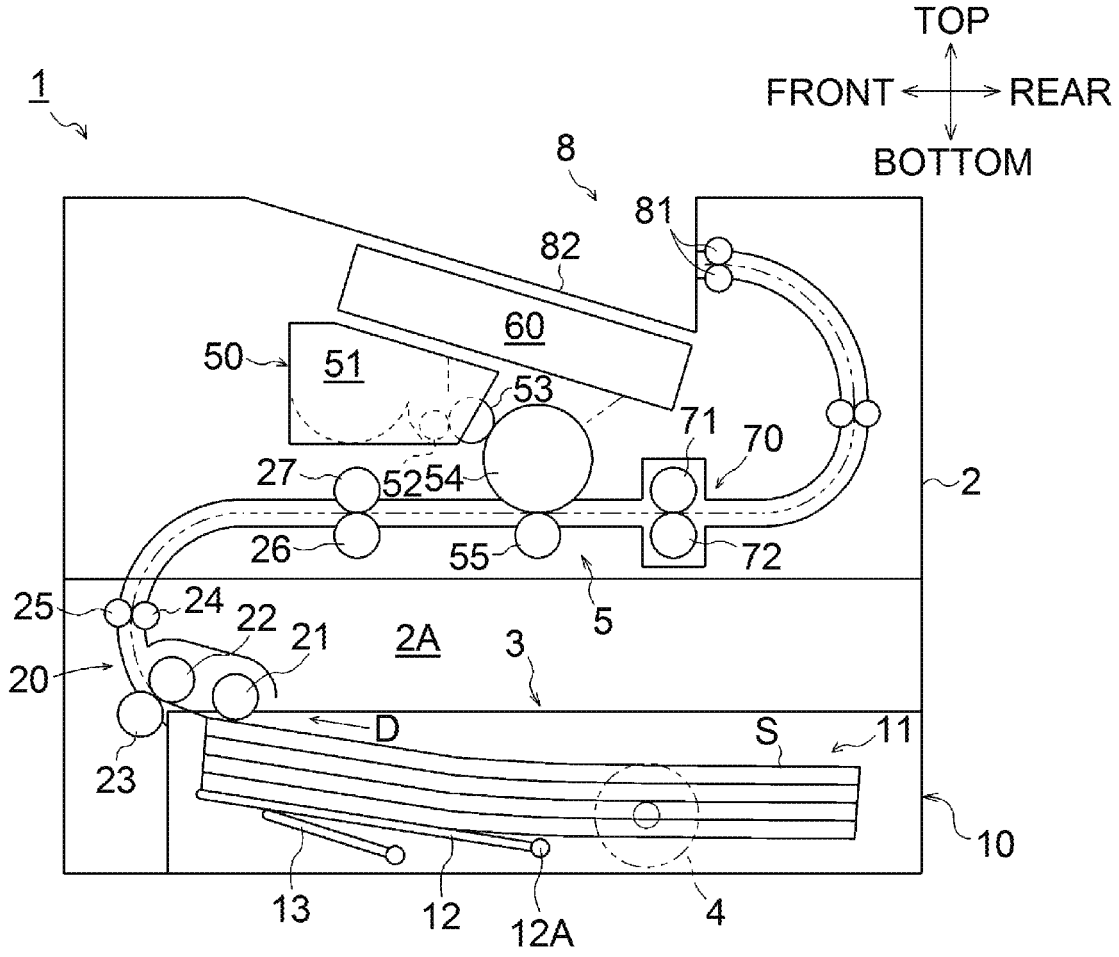
FIG. 1 is a cross-sectional view of an image forming apparatus in an illustrative embodiment according to one or more aspects disclosed herein.

In the following description, directions are defined with reference to an orientation of an image forming apparatus 1 that may be disposed in an orientation in which it may be intended to be used as illustrated in FIG. 1. A direction toward which a sheet tray 10 is drawn from the image forming apparatus 1 may be defined as the front, and the opposite direction may be defined as the rear. A right-left direction may be defined with respect to the image forming apparatus 1 as viewed from the front of the image forming apparatus 1. A side of the image forming apparatus 1, in which a discharge tray 82 may be provided, may be defined as the top of the image forming apparatus 1, and the opposite side may be defined as the bottom.

Overall Configuration of Image Forming Apparatus

As illustrated in FIG. 1, the image forming apparatus 1 includes a housing 2, a feed unit 3, a motor 4, an image forming unit 5, and a discharge unit 8. Examples of image forming apparatuses include the image forming apparatus 1. Examples of image forming units include the image forming unit 5.

The feed unit 3 is disposed at a lower portion of the image forming apparatus 1. The feed unit 3 is configured to store one or more sheets S and feed the one or more sheets S one by one to the image forming unit 5. The image forming unit 5 is disposed downstream from the feed unit 3 in a direction in which a sheet S is conveyed in the image forming apparatus 1 (hereinafter, referred to as the "conveyance direction"). The image forming unit 5 is configured to form an image onto a sheet S fed by the feed unit 3. The discharge unit 8 is disposed downstream from the image forming unit 5 in the conveyance direction. The discharge unit 8 is configured to discharge a sheet S having an image formed by the image forming unit 5, to the outside of the image forming apparatus 1.

The feed unit 3 includes the sheet tray 10, a feed mechanism 20, a conveying roller 24, and a registration roller 26. Examples of constituents of a sheet conveyor include the feed mechanism 20.

The image forming apparatus 1 further includes a tray attachment portion 2A at a lower portion of the housing 2. The sheet tray 10 is detachably attachable to the tray attachment portion 2A. The sheet tray 10 is movable relative to the tray attachment portion 2A. More specifically, for example, for attaching the sheet tray 10 to the tray attachment portion 2A, the sheet tray 10 is moved into the image forming apparatus 1 from front toward the rear of the image forming apparatus 1 relative to the tray attachment portion 2A. The sheet tray 10 may be thus positioned at an attached position. For pulling out the sheet tray 10, the sheet tray 10 is moved toward the front from the attached position relative to the tray attachment portion 2A. The sheet tray 10 may be thus positioned at an exposed position.

The sheet tray 10 includes a tray body 11, a support plate 12, and a raising member 13. The tray body 11 is configured to support one or more sheets S. The support plate 12 is disposed at the tray body 11. The support plate 12 is configured to support the one or more sheets S and change the position of the one or more sheets S in a top-bottom direction. The raising member 13 is configured to raise the support plate 12.

The support plate 12 is supported by a pivot 12A. The support plate 12 is configured to pivot in the top-bottom direction about the pivot 12A. The raising member 13 is configured to be driven by the motor 4 such that its distal end moves upward. The upward movement of the distal end of the raising member 13 raises the support plate 12 to move upward, to a feedable position (refer to FIG. 1), the one or more sheets S supported by the support plate 12.

The feed mechanism 20 is configured to separate a single sheet S from the remainder placed in the sheet tray 10 and feed the separated sheet S toward the conveying roller 24. The feed mechanism 20 further includes a feed roller 21, a separation roller 22 as an example of a drive roller, and a retard roller 23.

The feed roller 21 is disposed above the support plate 12. The feed roller 21 is configured to feed, in a feed direction D (refer to FIG. 2), one or more of the one or more sheets S positioned at the feedable position by the support plate 12. The feed direction D may refer to a direction in which one or more sheets S are fed from the sheet tray 10. The separation roller 22 is disposed downstream from the feed roller 21 in the conveyance direction. The retard roller 23 faces the separation roller 22. The retard roller 23 is urged toward the separation roller 22 to form a nip with the separation roller 22.

The feed roller 21 is configured to feed one or more sheets S toward the separation roller 22. In a case where the feed roller 21 feeds two or more sheets S, the separation roller 22 and the retard roller 23 separate a single sheet S from the fed sheets S and convey the separated sheet S toward the conveying roller 24. In a case where the feed roller 21 feeds a single sheet S, the separation roller 22 and the retard roller 23 convey the fed sheet S toward the conveying roller 24.

The conveying roller 24 is configured to apply a conveying force to a sheet S. The conveying roller 24 is disposed downstream from the feed mechanism 20 in the conveyance direction. The conveying roller 24 is disposed facing a cleaning roller 25 for removing paper dust from a sheet S. The conveying roller 24 and the cleaning roller 25 are configured to pinch a sheet S fed from the feed mechanism 20 and further convey the sheet S toward the registration roller 26.

The registration roller 26 is disposed downstream from the conveying roller 24 in the conveyance direction. The registration roller 26 is disposed facing another registration roller 27. The registration roller 26 is configured to pinch and convey a sheet S with the registration roller 27. The registration roller 26 is further configured to temporarily stop conveyance of a sheet S by restricting further movement of the leading edge of the sheet S, and restart conveyance of the sheet S toward a transfer position at a predetermined timing.

The image forming unit 5 includes a process cartridge 50, an exposure device 60, and a fixing device 70. The process cartridge 50 is configured to transfer an image onto a sheet S fed from the feed unit 3. The exposure device 60 is configured to expose a circumferential surface of a photosensitive drum 54 of the process cartridge 50. The fixing device 70 is configured to fix an image transferred onto a sheet S by the process cartridge 50.

The process cartridge 50 is disposed above the tray attachment portion 2A in the housing 2. The process cartridge 50 includes a developer chamber 51, a supply roller 52, a developing roller 52, the photosensitive drum 54, and a transfer roller 55.

The developer chamber 51 stores developer (e.g., toner) therein. The process cartridge 50 further includes an agitator. The agitator is configured to agitate toner to supply toner onto a circumferential surface of the supply roller 52. The supply roller 52 is configured to further supply toner onto a circumferential surface of the developing roller 53.

The developing roller 53 is in intimate contact with the supply roller 52. The developing roller 53 is configured to carry toner supplied by the supply roller 52. The toner carried by the developing roller 53 may be charged by a contact member that may be slidable relative to the developing roller 53. The developing roller 53 is configured to be applied with a developing bias by a bias application device.

The photosensitive drum 54 is disposed adjacent to the developing roller 53. A circumferential surface of the photosensitive drum 54 may be uniformly charged by a charger and then exposed by the exposure device 60. Such exposure may cause a portion of the circumferential surface of the photosensitive drum 54 to have lower potential than the other portion of the photosensitive drum 54, thereby forming an electrostatic latent image based on image data on the circumferential surface of the photosensitive drum 54. Thereafter, the developing roller 53 supplies the charged toner onto the circumferential surface of the photosensitive drum 54 to visualize the electrostatic latent image, thereby forming a developer image on the circumferential surface of the photosensitive drum 54.

The transfer roller 55 is disposed facing the photosensitive drum 54. The transfer roller 55 is configured to be applied with a transfer bias by the bias application device. In a state where the circumferential surface of the transfer roller 55 is being applied with a transfer bias, the transfer roller 55 and the photosensitive drum 54 having a developer image pinch a sheet S therebetween (e.g., at the transfer position) and convey the sheet S forward, thereby transferring the developer image onto the sheet S from the circumferential surface of the photosensitive drum 54.

The exposure device 60 includes a laser diode, a polygon mirror, and reflectors. The exposure device 60 is configured to expose the circumferential surface of the photosensitive drum 54 by emitting a laser beam toward the circumferential surface of the photosensitive drum 54 based on image data inputted to the image forming apparatus 1.

The fixing device 70 includes a heat roller 71 and a pressure roller 72. The heat roller 71 is configured to rotate by a driving force from the motor 4. The heat roller 71 is further configured to heat by application of power from a power supply. The pressure roller 72 is disposed facing the heat roller 71. The pressure roller 72 is in intimate contact with the heat roller 71. The pressure roller 72 is configured to rotate following rotation of the heat roller 71. In response to a sheet S having a transferred developer image reaching the fixing device 70, the heat roller 71 and the pressure roller 72 pinch and convey the sheet S to fix the developer image onto the sheet S.

The discharge unit 8 includes a discharge roller pair 81 and a discharge tray 82. The discharge roller pair 81 is configured to discharge, to the outside of the housing 2, a sheet S that has passed the fixing device 70. The discharge tray 82 is defined at a top of the housing 2. The discharge tray 82 is configured to support one or more sheets S discharged to the outside of the housing 2 by the discharge roller pair 81.

Configuration of Feed Mechanism

Figure 2:
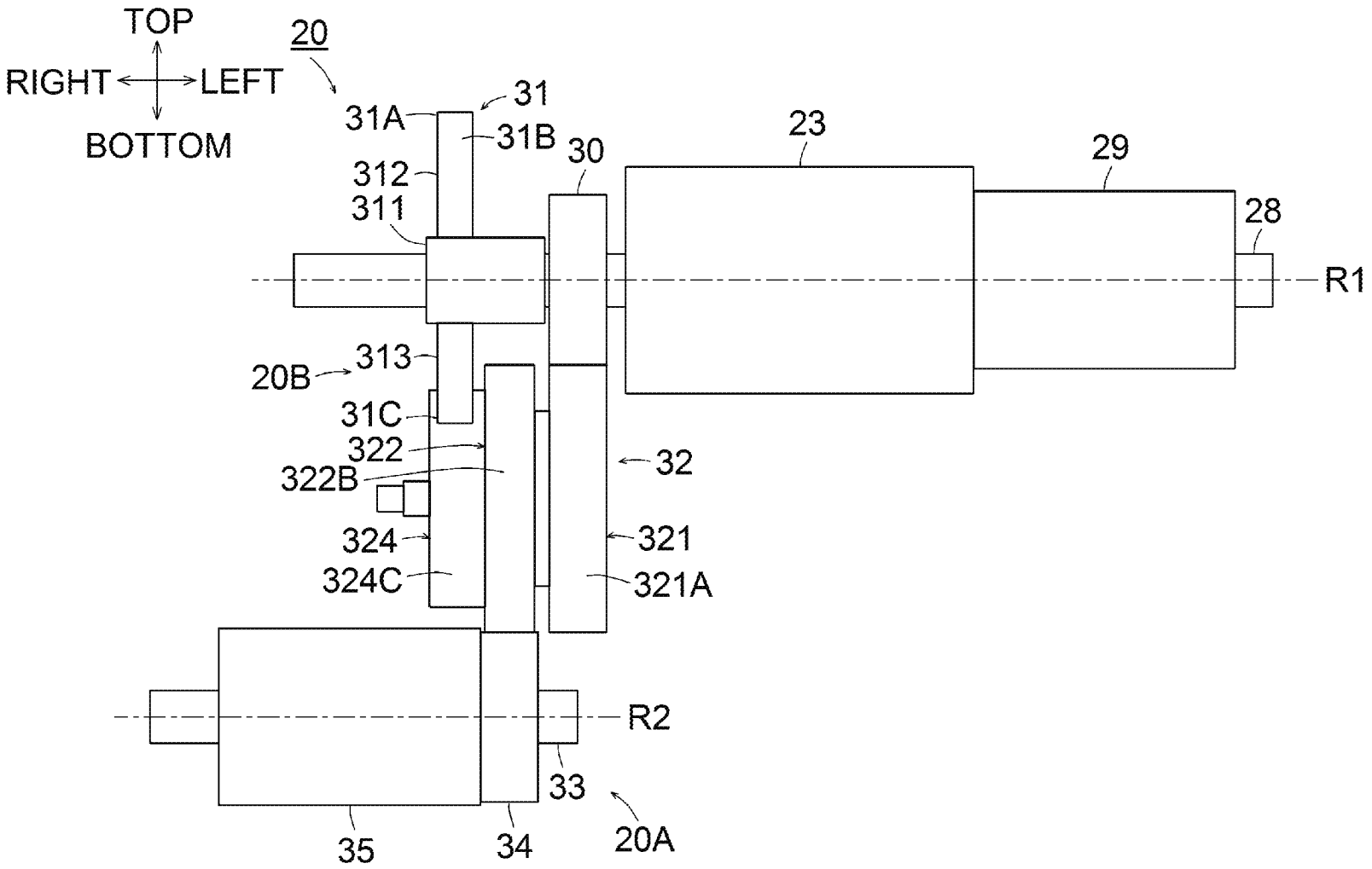
FIG. 2 is a rear view of a feed mechanism.
Figure 3:
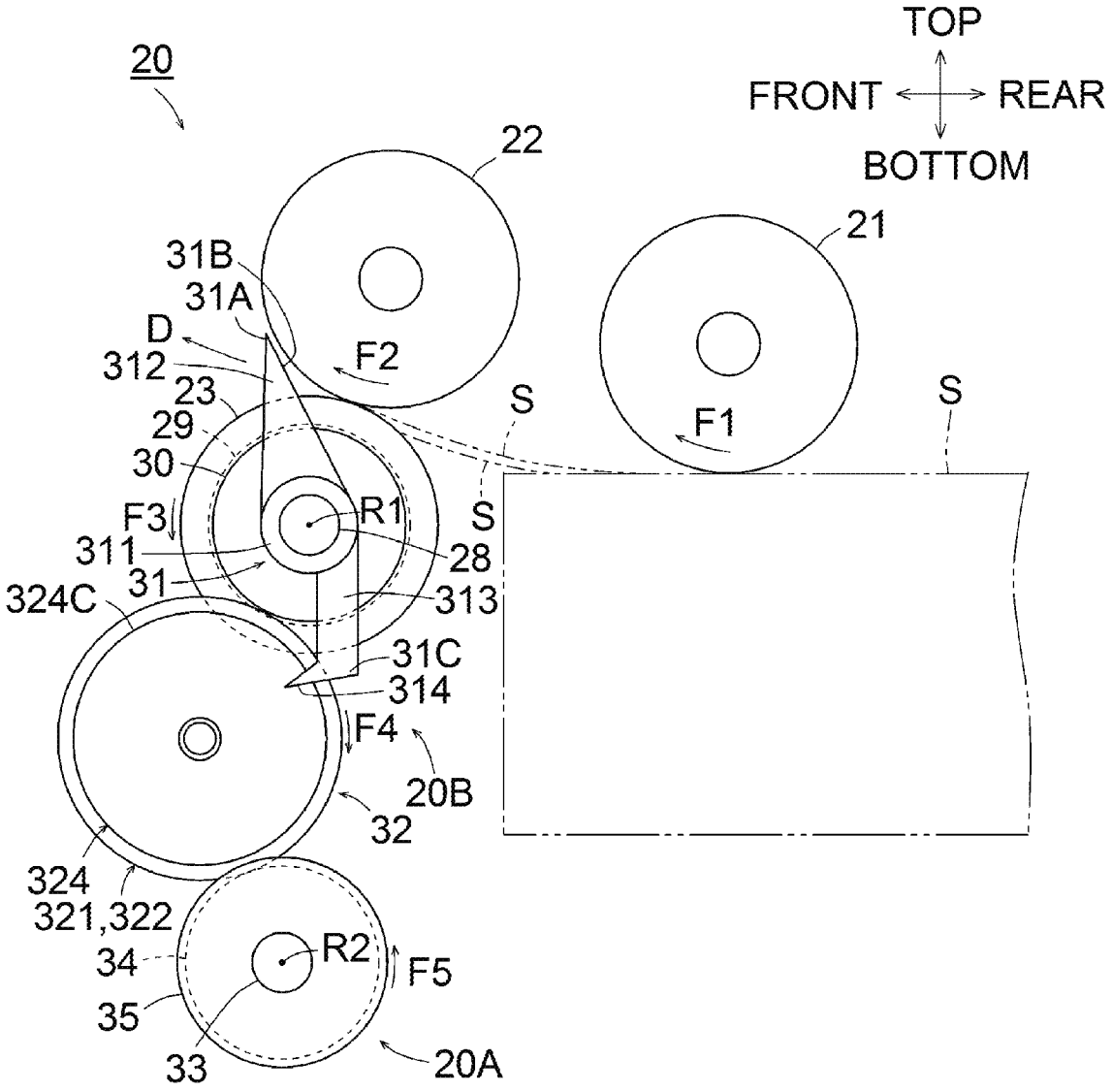
FIG. 3 is a right side view of the feed mechanism.
Figure 4:
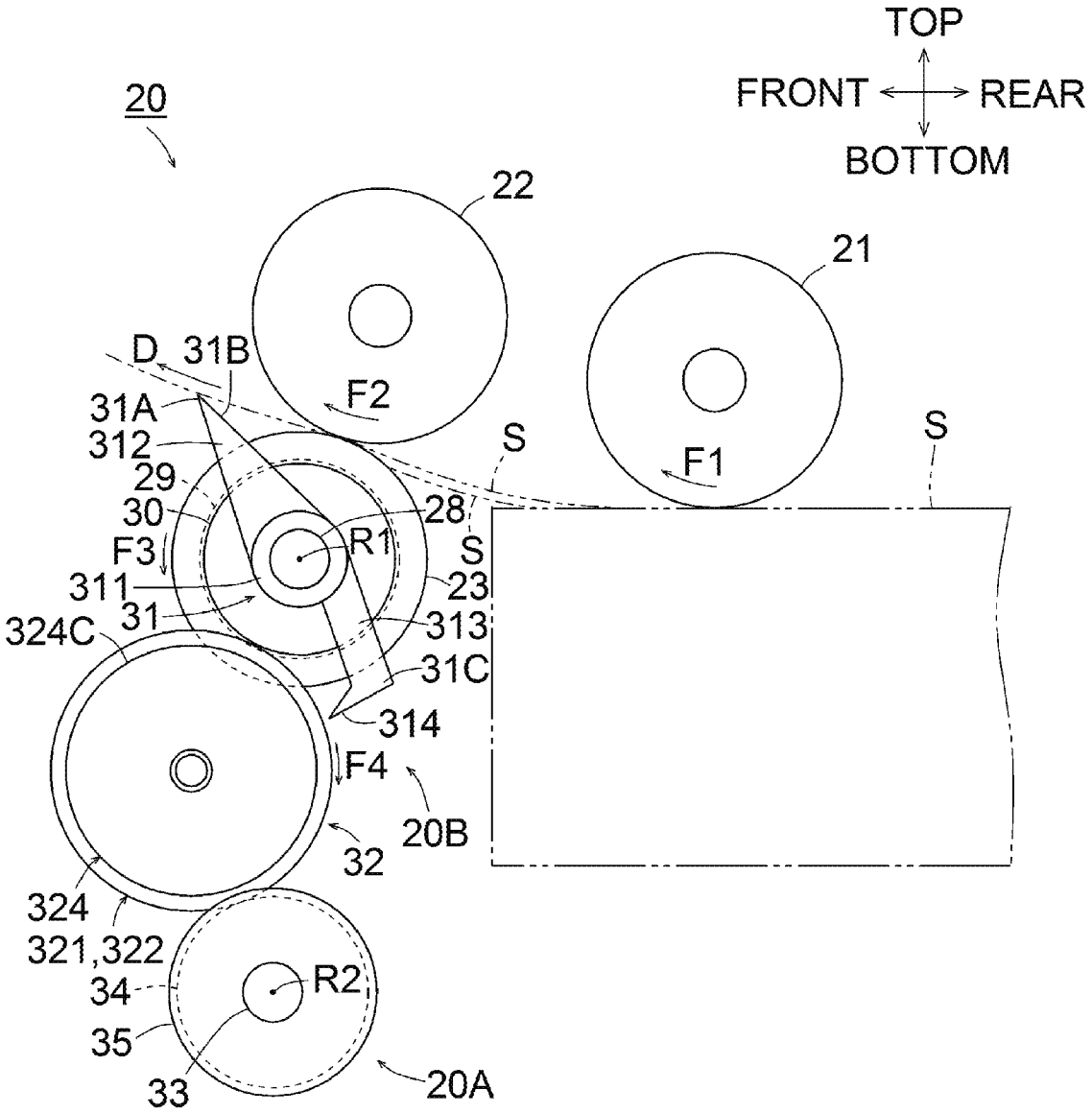
FIG. 4 is a right side view of the feed mechanism.

Referring to FIGS. 2, 3, and 4, the configuration of the feed mechanism 20 will be described. FIG. 3 illustrates a feed and separation operation, wherein the retard roller 23 is separating a leading edge of a single sheet S from one or more sheets S fed from the sheet tray 10. FIG. 4 illustrates a conveying operation, wherein, subsequent to the feed and separation, a trailing edge of the sheet S has passed through the retard roller 23.

As illustrated in FIG. 2, the feed mechanism 20 includes a first shaft 28, a first torque limiter 29, a first gear 30, an arm member 31, a planetary gear 32, a second shaft 33, a second gear 34, and a second torque limiter 35 as well as the feed roller 21, the separation roller 22, and the retard roller 23.

The arm member 31, the planetary clutch 32, the second gear 34, and the second torque limiter 35 may constitute a drive train 20A. The constituents of the drive train 20A are not limited to such specific examples. The drive train 20A includes a plurality of gears for receiving a driving force from the first gear 30 and is disposed in front of the sheet tray 10. The arm member 31 and the planetary clutch 32 may constitute a switching mechanism 20B. The constituents of the switching mechanism 20B are not limited to such specific examples. The switching mechanism 20B is configured to selectively allow or interrupt transmission of a driving force from the first gear 30 to the second torque limiter 35.

The first shaft 28 is configured to rotate on a first axis R1 extending in the right-left direction. On the first shaft 28, the first torque limiter 29, the retard roller 23, and the arm member 31 are positioned in this order from the left.

The first torque limiter 29 is disposed adjacent to a left surface of the retard roller 23 and on the first shaft 28. The first torque limiter 29 is configured to apply a first load to the retard roller 23. The first gear 30 is disposed to the right of the retard roller 23 and on the second shaft 28. The first gear 30 is configured to rotate together with the first shaft 28.

The arm member 31 is movable, for example, pivotable, to selectively allow or interrupt transmission of a driving force from the first gear 30 to the second torque limiter 35. The arm member 31 is disposed to the right of the first gear 30 and on the first shaft 28. As illustrated in FIG. 3, the arm member 31 includes a support portion 311 supported by the first shaft 28, a first arm 312 extending upward from the support portion 311, and a second arm 313 extending downward from the support portion 311.

The support portion 311 has a hole which receives the first shaft 28 therein. The support portion 311 is supported by the first shaft 28 such that the arm member 31 is pivotable on the first axis R1. The first arm 312 has a length such that its movable end or a first end 31A is more downstream in the conveyance direction than the separation roller 22 is. The first arm 312 has, on its rear surface, a contact portion 31B, which a conveyed sheet S contacts. The first arm 312 is configured to pivot frontward when a conveyed sheet S contacts the contact portion 31B.

The second arm 313 has a length such that its movable end or a second end 31C reaches the planetary clutch 32. The second end 31C has a protruding hook 314, which is engageable with an outer gear portion 324C of the planetary clutch 32. The second arm 313 is configured to pivot rearward when a sheet S presses the first arm 312 frontward. When the second arm 313 pivots rearward, the hook 314 moves away from the outer gear portion 324C.

The arm member 31 has a shape such that a length from the first axis R1 to the first end 31A is longer than a length from the first axis R1 to the second end 31C. This configuration uses the principle of the lever, which allows even a soft or floppy sheet S to press the arm member 31.

During the feed and separation operation illustrated in FIG. 3, the arm member 31 is located, by its own weight or an urging force of an urging member, at a first arm position, or an input position where the hook 314 is engaged with the outer gear portion 324C of the planetary clutch 32. During the conveying operation illustrated in FIG. 4, the arm member 31 is pressed by a sheet S and located at a second arm position, or an interruption position where the hook 314 is spaced from the outer gear portion 324C of the planetary clutch 32. When the arm member 31 is at the input position, a driving force is transmitted from the first gear 30 via the planetary clutch 32 to the second torque limiter 35. When the arm member 31 is at an interruption position, the planetary clutch 32 interrupts the transmission from the first gear 30 to the second torque limiter 35.

As described above, the arm member 31 is pivotable on the first axis R1 and disposed near the nip between the separation roller 22 and the retard roller 23. A nipped sheet S having an increased stiffness contacts the arm member 31, and thus reliably presses the arm member 31.

In other words, the arm member 31 has the first end 31A to contact a sheet S, and the second end 31C opposite to the first end 31A relative to the first axis R1 to cause the arm member 31 to selectively allow or interrupt transmission of the driving force to the second torque limiter 35.

Figure 5A:
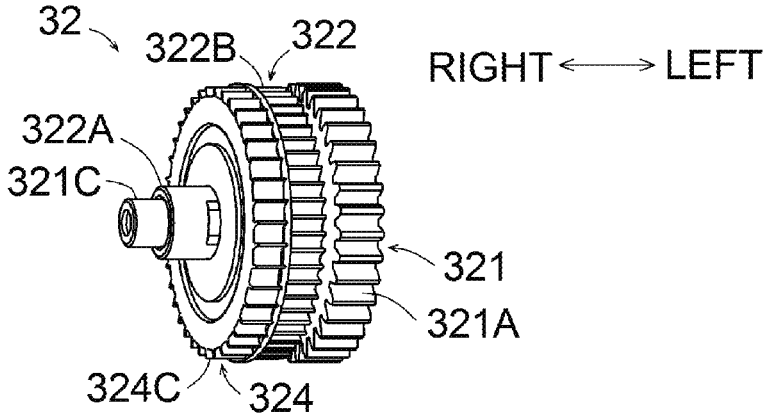
FIG. 5A is a right perspective view of a planetary clutch.
Figure 5B:
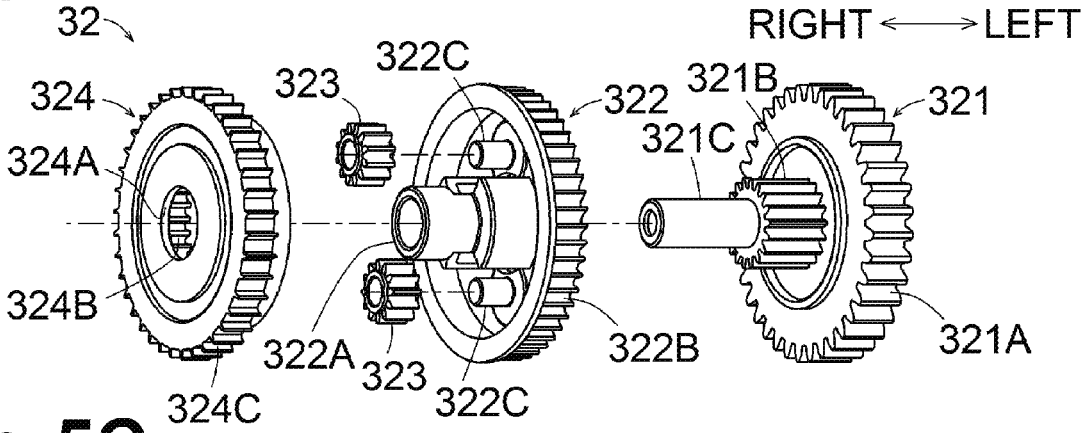
FIG. 5B is a right exploded view of the planetary clutch.
Figure 5C:
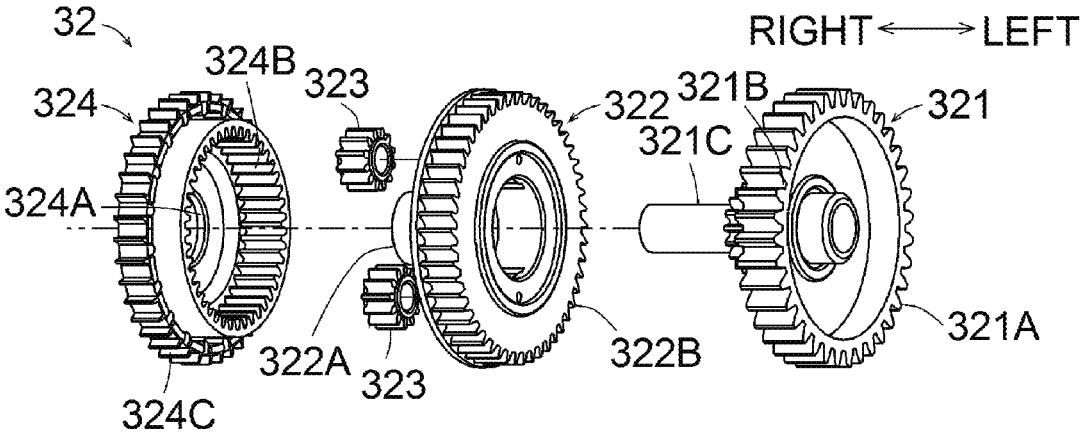
FIG. 5C is a left exploded view of the planetary clutch.

Referring to FIGS. 5A, 5B, and 5C, the planetary clutch 32 will be described. The planetary clutch 32 includes a third gear 321, a fourth gear 322, two fifth gears 323, and a sixth gear 324. The third gear 321 includes an input gear portion 321A, a sun gear portion 321B, and a shaft portion 321C, which constitute a single-piece assembly and are inseparable from one another. The input gear portion 312A is disposed in engagement with the first gear 30 to receive a driving force from the first gear 30. The shaft portion 321C has a rotation axis for the input gear portion 321A and the sun gear portion 321B.

The fourth gear 322 includes a tubular portion 322A, an output gear portion 322B, and a planetary carrier portion 322, which constitute a single-piece assembly and are in separable from one another. The tubular portion 322A is rotatably supported by the shaft portion 321C. The output gear portion 322B is disposed in engagement with the second gear 34 and configured to rotate about the tubular portion 322A and output a driving force to the second gear 34. The planetary carrier portion 322C includes two bosses inside the output gear portion 322B. The fifth gears 323 are planetary gears rotatably supported by respective bosses on the planetary carrier portion 322C.

The sixth gear 324 has a hole 324A as a rotation axis and includes an inner gear portion 324B and an outer gear portion 324C, which constitute a single-piece assembly and are inseparable from each other. The sixth gear 324 is rotatably supported by the tubular portion 322A inserted into the hole 324A. The inner gear portion 324B is disposed in engagement with the fifth gears 323. The outer gear portion 324C is engageable with the hook 314 of the arm member 31. The outer gear portion 324C is an example of an engagement portion.

When the arm member 31 is at the input position and the hook 314 engages with the outer gear portion 324C, the sixth gear 324 is fixed. With this state, a driving force from the first gear 30 causes the input gear portion 321A to rotate together with the sun gear portion 321B, which transmits the driving force to the fifth gears 323. As the sixth gear 324 is fixed, the fifth gears 323 rotate on their own axes and revolve around the sun gear portion 321B. This allows the fourth gear 322 to rotate in the same direction as the third gear 321, transmitting the driving force from the output gear portion 322B to the second gear 34. Thus, the planetary clutch 32 inputs the driving force to the second torque limiter 35.

When the arm member 31 is at the interruption position and the hook 314 is spaced from the outer gear portion 324C, the sixth gear 324 becomes rotatable. With this state, a driving force from the first gear 30 causes the input gear portion 321A to rotate together with the sun gear portion 321B, which transmits the driving force to the fifth gears 323. As the sixth gear 324 is rotatable, the fifth gears 323 rotate on their own axes and do not revolve around the sun gear portion 321B. This allows the fifth gears 323 to transmit the rotational force to the inner gear portion 324B, and thus the sixth gear 324 rotates. As the fifth gears 323 do not revolve around the sun gear portion 321B, the fourth gear 322 does not rotate. Thus, the planetary clutch 32 interrupts the transmission of the driving force to the second torque limiter 35.

The second shaft 33 is configured to rotate on a second axis R2 extending in the right-left direction. On the second shaft 33, the second gear 34 and the second torque limiter 35 are positioned in this order from the left.

The second gear 34 is disposed to the left of the second torque limiter 35 and on the second shaft 33. The second gear 34 is configured to rotate together with the second shaft 33. The second gear 34 is disposed in engagement with the output gear portion 322B. The second gear 34 is configured to rotate when receiving the driving force from the output gear portion 322B. The second torque limiter 35 is disposed to a right surface of the second gear 34 and on the second shaft 33. The second torque limiter 35 is configured to apply a second load to the second gear 34.

Operations of Feed Mechanism

Hereinafter, a description will be provided on operations performed by the feed mechanism 20 during conveyance of a sheet S. Referring to FIG. 3, the feed and separation operation will be described. The feed and separation operation starts from feeding of one or more sheets S from the sheet tray 10 and ends with separation of a leading edge of a single sheet S from the fed one or more sheets S by the retard roller 23. During the feed and separation operation, the arm member 31 is at the input position.

The feed and separation operation starts when the feed roller 41 and the separation roller 42 are driven by the motor 4. To convey a sheet S in the feed direction D, the feed roller 21 rotates in the direction of the arrow F1 and the separation roller 22 rotates in the direction of the arrow F2. The rotation of the separation roller 22 in the direction of the arrow F2 causes the retard roller 23 forming the nip with the separation roller 22 to rotate in the direction of the arrow F3. At that time, the first torque limiter 29 generates and applies a first load to the retard roller 23.

The rotation of the retard roller 23 causes the first shaft 28 and the first gear 30 to rotate in the direction of the arrow F3. The rotation of the first gear 30 in the direction of the arrow F3 causes the third gear 321 and the fourth gear 322 of the planetary clutch 32 to rotate in the direction of the arrow F4. The rotation of the fourth gear 322 in the direction of the arrow F4 causes the second gear 34 to rotate in a direction of an arrow F5.

At that time, the second torque limiter 35 generates and applies a second load to the second gear 34. The second load generated by the second torque limiter 34 is transmitted to the retard roller 23 via the planetary clutch 32 and the first gear 30. The retard roller 23 is thus subjected to the first load and the second load. To rotate the retard roller 23 in the direction of the arrow F3, a load greater than a combination of the first load and the second load is required.

In such a state, the feed roller 21 feeds one or more sheets S in the feed direction D from the sheet tray 10. In a case where the feed roller 21 feeds a single sheet S, the separation roller 22 and the retard roller 23 nip the sheet S therebetween and normally convey the sheet S in the feed direction D. In a case where, as illustrated in FIG. 3, the feed roller 21 feeds a plurality of, for example, two, sheets S at a time (hereinafter, such a situation may also be referred to as "multiple sheet feeding"), the separation roller 22 and the retard roller 23 nip the both sheets S therebetween with leading edge portions of the sheets S overlapping each other.

As illustrated in FIG. 3, in a state where the separating roller 22 and the retard roller 23 nip the both sheets S, a frictional force acting between the two sheets S may be smaller than a frictional force acting between the upper sheet S and the separation roller 22, and may also be smaller than a frictional force acting between the lower sheet S and the retard roller 23. Such difference in frictional force thus causes the upper and lower sheets S to slip relative to each other, thereby hardly transmitting the driving force to the retard roller 23 via the separation roller 22. Consequently, the separation roller 22 rotating in the direction of the arrow F2 by the driving force from the motor 4 conveys only the upper sheet S in the feed direction D.

In this state, the driving force transmitted to the retard roller 23 via the separation roller 22 for rotating the retard roller 23 in the direction of the arrow F3 may be smaller than the combined load of the first load generated by the first torque limiter 29 and the second load generated by the second torque limiter 35. Thus, the retard roller 23 stops rotating in the direction of the arrow F3. The retard roller 23 therefore blocks further movement of the lower sheet S in the feed direction D. As described above, the retard roller 23 may function as a passive roller, thereby improving performance of separating leading edge portions of sheets S.

Referring to FIG. 4, the conveying operation will be described. The conveying operation starts subsequent to the feed and separation operation and ends with completion of passage of a trailing edge of the sheet S through the retard roller 23. The separation roller 22 and the retard roller 23 nip a sheet S therebetween and convey the sheet S in the feed direction D. A leading edge of the sheet S passing through the nip contacts and presses the contact portion 31B of the first arm 312 frontward. As the first arm 312 is pressed frontward, the second arm 313 pivots rearward and the hook 314 moves away from the outer gear portion 324C. In other words, the arm member 31 moves to the interruption position.

While the sheet S is conveyed, the retard roller 23 rotates in the direction of the arrow F3. At that time, the first torque limiter 29 generates and applies a first load to the retard roller 23.

The rotation of the retard roller 23 causes the first shaft 28 and the first gear 30 to rotate in the direction of the arrow F3. The rotation of the first gear 30 in the direction of the arrow F3 causes the third gear 321 and the sixth gear 324 of the planetary clutch 32 to rotate in the direction of the arrow F4. At that time, the fourth gear 322 does not rotate. Thus, the planetary clutch 32 interrupts the transmission of the driving force to the second torque limiter 35. Consequently, the retard roller 23 is subjected to only the first load generated by the first torque limiter 29.

In a case where, during sheet conveyance, the feed roller 21 feeds, at a time, a plurality of, for example, two, sheets S including a first sheet S and a second sheet S to be fed subsequent to the first sheet S, the separation roller 22 and the retard roller 23 nip both the first and second sheets S with a leading edge of the second sheet S overlapping below the first sheet S. In such a state, the feed roller 24 feeds only the upper (e.g., first) sheet S in the feed direction D.

In this state, frictional force acting between the lower sheet S and the retard roller 23 may be greater than the frictional force acting between the lower sheet S and the upper sheet S. The lower (e.g., second) sheet S may thus slip relative to the upper sheet S. Such relative slippage of the sheets S may hardly allow transmission of the driving force of the conveying roller 24 to the retard roller 23 via the upper sheet S being conveyed. Thus, the driving force transmitted to the retard roller 23 becomes smaller than the first load generated by the first torque limiter 29, and the retard roller 23 stops rotating in the direction of the arrow F3. The retard roller 23 therefore blocks further movement of the lower sheet S in the feed direction D.

As described above, the retard roller 23 may function as the passive roller, thereby improving performance of separating sheets S if multiple sheet feeding occurs during sheet conveyance.

In the feed mechanism 20, when a leading edge of a sheet S reaches the nip between the separation roller 22 and the retard roller 23, the arm member 31 is at the input position, and the retard roller 23 is subjected to the first load generated by the first torque limiter 29 and the second load generated by the second torque limiter 35. If multiple sheet feeding occurs, this configuration enables the separation roller 22 and the retard roller 23 to separate sheets S therebetween with leading edge portions of the sheets S overlapping each other and convey a single sheet S only.

When the separated sheet S is conveyed, the leading edge of the sheet S contacts the arm member 31, and the arm member 31 moves to the interruption position. Consequently, the retard roller 23 is subjected to only the first load generated by the first torque limiter 29. Thus, while the separated sheet S is conveyed, an amount of load applied to the retard roller 23, which will be a conveyance resistance to the sheet S, is reduced. The sheet conveyor switches an amount of load applied to the retard roller 23, simply using the switching mechanism 20B that is mechanical in structure, instead of using an electrical structure, for example, an electromagnetic clutch. Thus, the sheet conveyor using the mechanically structured switching mechanism 20B can be produced at a lower cost and in a smaller size than a sheet conveyor using an electromagnetic clutch.

Alternative Embodiment of Switching Mechanism

Figure 6:
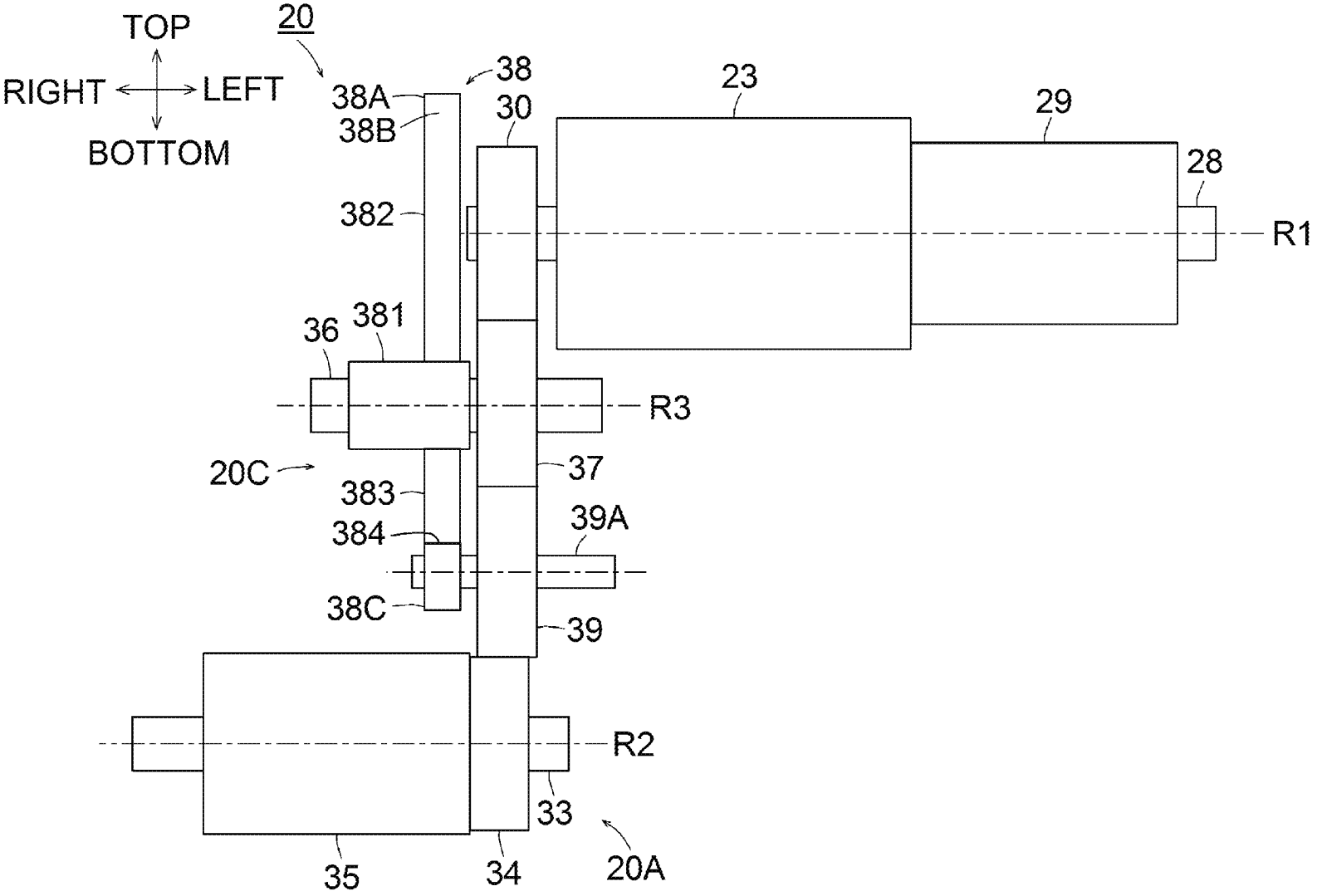
FIG. 6 is a rear view of a feed mechanism using an alternative switching mechanism according to one or more aspects disclosed herein.
Figure 7:
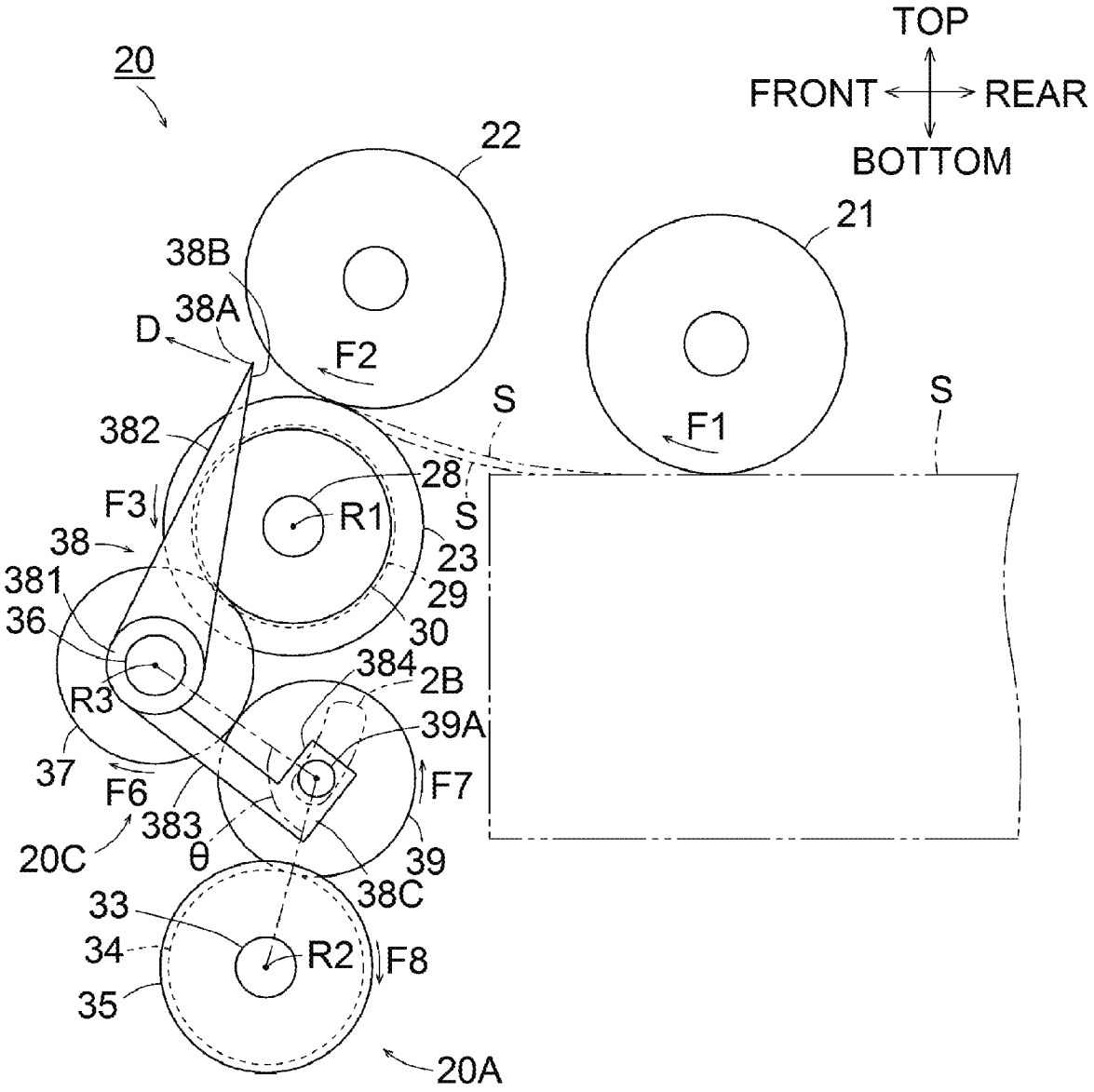
FIG. 7 is a right side view of the feed mechanism using the alternative switching mechanism.
Figure 8:
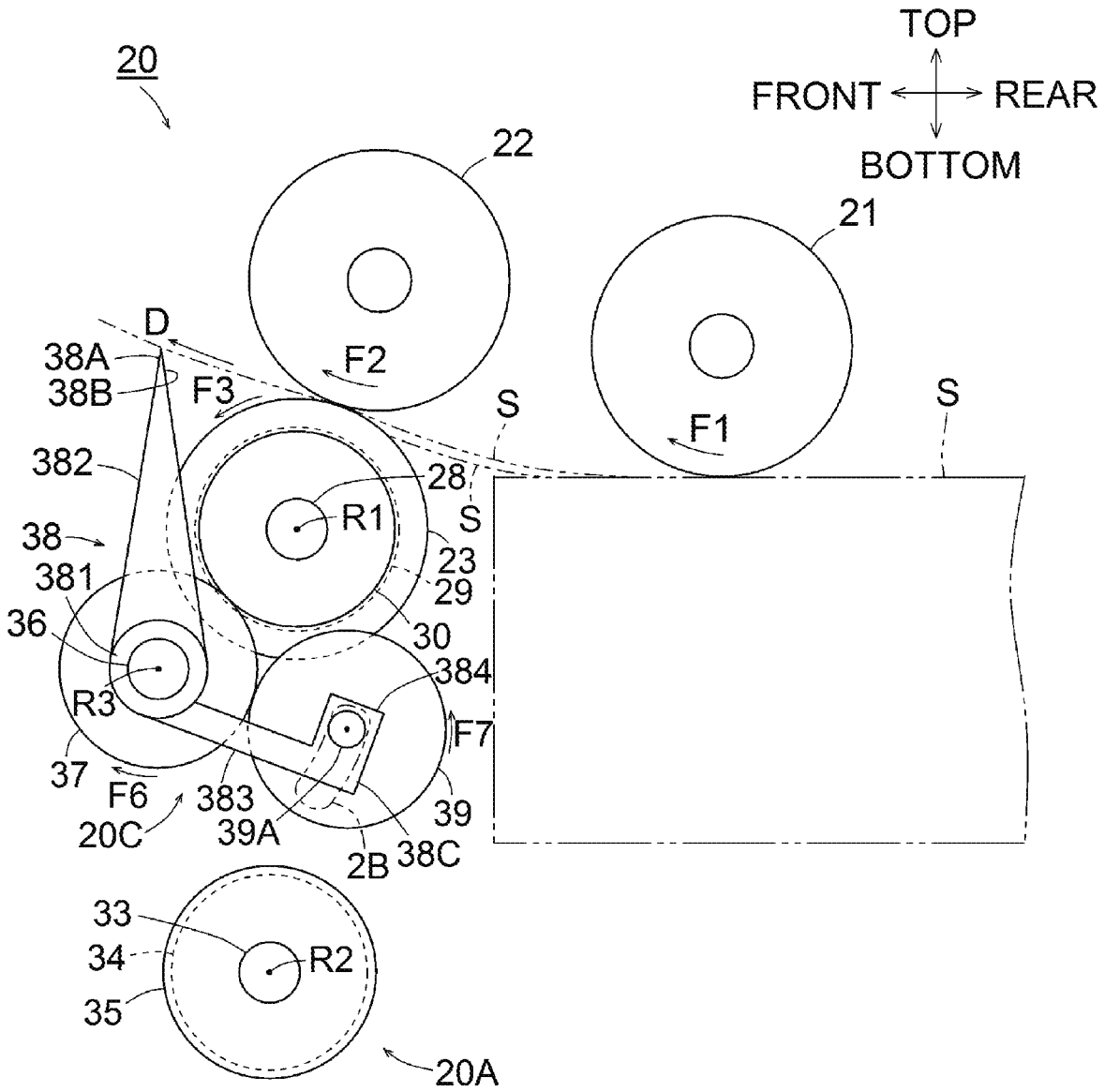
FIG. 8 is a right side view of the feed mechanism using the alternative switching mechanism.

The switching mechanism 20B using the planetary clutch 32 may be replaced with a switching mechanism 20C using a pendulum gear. Referring to FIGS. 6, 7, and 8, the feed mechanism 20 including the switching mechanism 20C will be described. FIG. 7 illustrates a feed and separation operation, wherein the retard roller 23 is separating a leading edge of a single sheet S from one or more sheets S fed from the sheet tray 10. FIG. 8 illustrates a conveying operation, wherein, subsequent to the feed and separation, a trailing edge of the sheet S is about to pass the retard roller 23.

As illustrated in FIG. 6, the switching mechanism 20C includes a third shaft 36, an idle gear 37, an arm member 38, and a pendulum gear 39.

The third shaft 36 is configured to rotate on a third axis R3 extending in the right-left direction. On the third shaft 36, the idle gear 37 and the arm member 38 are positioned in this order from the left. The idle gear 37 is disposed in engagement with the first gear 30 and on the third shaft 36. The idle gear 37 is configured to rotate together with the third shaft 36.

The arm member 38 is pivotable to selectively allow or interrupt transmission of a driving force from the first gear 30 to the second torque limiter 35. The arm member 38 is disposed to the right of the idle gear 37 and on the third shaft 36. As illustrated in FIG. 7, the arm member 38 includes a support portion 381 supported by the third shaft 36, a first arm 382 extending upward and slightly rearward from the support portion 381, and a second arm 383 extending downward and slightly rearward from the support portion 381.

The support portion 381 has a hole which receives the third shaft 36 therein. The support portion 381 is supported by the third shaft 36 such that the arm member 38 is pivotable on the third axis R3. The first arm 382 has a length such that its movable end or a first end 38A is more downstream in the conveyance direction than the separation roller 22 is. The first arm 382 has, on its rear surface, a contact portion 38B, which a conveyed sheet S contacts. The first arm 382 is configured to pivot frontward when a conveyed sheet S contacts the contact portion 38B.

The second arm 383 has a length such its movable end or a second end 38C supports the pendulum gear 39. The second end 38C has a protrusion 384 having a hole for supporting the pendulum gear 39. The second arm 383 is configured to pivot rearward when the first arm 382 is pressed frontward by a sheet S. When the second arm 383 pivots rearward, the pendulum gear 39 moves upward away from the second gear 34.

The arm member 38 has a shape such that a length from the third axis R3 to the first end 38A is longer than a length from the third axis R3 to the second end 38C. This configuration uses the principle of the lever, which allows even a soft or floppy sheet S to press the arm member 38.

In other words, the arm member 38 includes the first end 38A to contact a sheet S, and the second end 38C located opposite to the first end 38A relative to the third axis R3 to selectively allow or interrupt the transmission of the driving force to the second torque limiter 35.

The protrusion 384 supports the pendulum gear 39 such that the pendulum gear 39 is engageable with the idle gear 37. The pendulum gear 39 includes a shaft 39A configured to rotate on a rotation axis extending in the right-left direction. The shaft 39A has a right end portion, which is inserted into the hole in the protrusion 384 of the second arm 383 and thus rotatably supported by the arm member 38. The shaft 39A has a left end portion, which engages in a guide groove 2B (FIG. 7) on the housing 2 to be guided along the guide groove 2B.

As illustrated in FIG. 7, during the feed and separation operation, the idle gear 37 rotates in the direction of the arrow F6, and the pendulum gear 39 rotates in the direction of an arrow F7. At that time, the pendulum gear 39 is subjected to a force having a direction to be pressed against the second gear 34 and is located at a first gear position where the pendulum gear 39 engages with the second gear 34. Thus, a driving force is transmitted from the first gear 30 via the pendulum gear 39 and the second gear 34 to the second torque limiter 35, and the second torque limiter 35 thus rotates in the direction of the arrow F8.

The retard roller 23 is thus subjected to the first load generated by the first torque limiter 29 and the second load generated by the second torque limiter 35. To rotate the retard roller 23 in the direction of the arrow F3, a driving force greater than a combination of the first load and the second load is required.

During the conveying operation illustrated in FIG. 8, as the first arm 382 is pressed frontward by a sheet S, the pendulum gear 39 is located at a second gear position where the pendulum gear 39 is spaced from the second gear 34. Thus, the pendulum gear 39 interrupts the transmission of the driving force from the first gear 30 to the second torque limiter 35. The retard roller 23 is thus subjected to only the first load generated by the first torque limiter 29. To rotate the retard roller 23 in the direction of the arrow F3, a driving force greater than the first load is required.

The alternative switching mechanism 20C can be used to selectively allow or interrupt the transmission of the driving force to the second torque limiter 35 and have the same results as with the above embodiment.

As illustrated in FIG. 7, when an angle θ, which is formed by a line passing through the third axis R3 and a rotation axis of the pendulum gear 39 and a line passing through the rotation axis of the pendulum gear 39 and the second axis R2, is in a range from 90 degrees to 130 degrees, the pendulum gear 39 at the input position is pressed against the second gear 34 with a small force. Thus, even a soft or floppy sheet S can press the arm member 38 frontward.

Other

In some embodiments, the arm member 38 of the alternative may be supported by the first shaft 28 of the above embodiment such that the arm member 38 is pivotable on the first axis R1, as in the arm member 31. As the arm member 38 may be disposed near the nip between the separation roller 22 and the retard roller 23, a nipped sheet S having an increased stiffness may contact the arm member 38, and thus reliably press the arm member 38.

The first arm 312, 382 may be used as a sheet sensor to detect a sheet S. In this case, an optical sensor or other device may be used to detect a part of the arm member 31, 38 movable between the input position and the interruption position.

Effects of Embodiments

The sheet conveyor mounted in the image forming apparatus 1 includes the separation roller 22 configured to convey a sheet S in the conveyance direction, and the retard roller 23 forming a nip with the separation roller 22. The sheet conveyor includes the first torque limiter 29 disposed coaxially with the retard roller 23 and communicating with the retard roller 23, and the first gear 30 disposed coaxially with the retard roller 23. The sheet conveyor further includes the drive train 20A and the second torque limiter 35. The drive train 20A includes a plurality of gears for receiving a driving force from the first gear 30. The second torque limiter 35 is disposed in the drive train 20A. The sheet conveyor includes the arm member 31 including the contact portion 31B. The contact portion 31B is located downstream from the separation roller 22 in the conveyance direction. The arm member 31 is movable between the first arm position to allow transmission of the driving force to the second torque limiter 35 and the second arm position to interrupt transmission of the driving force to the second torque limiter 35. The arm member 31 is configured to, as a sheet S conveyed by the separation roller 22 contacts the contact portion 31B, move from the first arm position to the second arm position.

In this configuration, when the leading edge of a sheet S reaches the nip between the separation roller 22 and the retard roller 23, the arm member 31 is at the first arm position and the retard roller 23 is subjected to the first load generated by the first torque limiter 29 and the second load generated by the second torque limiter 35. If multiple sheet feeding occurs, this configuration enables the separation roller 22 and the retard roller 23 to separate sheets S therebetween with leading edge portions of the sheets S overlapping each other and convey a single sheet S only. When the separated sheet S is conveyed, the leading edge of the sheet S contacts the contact portion 31B of the arm member 31, and the arm member 31 moves to the second arm position. Consequently, the retard roller 23 is subjected to only the first load generated by the first torque limiter 29. Thus, while the separated sheet S is conveyed, an amount of load applied to the retard roller 23, which will be a conveyance resistance to the sheet S, is reduced. The sheet conveyor switches an amount of load applied to the retard roller 23, simply using the switching mechanism 20B (that is, the arm member 31) that is mechanical in structure, instead of using an electrical structure, for example, an electromagnetic clutch. Thus, the sheet conveyor using the mechanically structured switching mechanism 20B can be produced at a lower cost and in a smaller size than a sheet conveyor using an electromagnetic clutch.

In the sheet conveyor, the switching mechanism 20B includes the planetary clutch 32 including the outer gear portion 324C. The arm member 31 includes the hook 314. When the arm member 31 is at the first arm position, the hook 314 is engaged with the outer gear portion 324C. When the arm member 31 is at the second arm position, the hook 314 is spaced from the outer gear portion 324C. The planetary clutch 32 is configured to, when the hook 314 is engaged with the outer gear portion 324C, allow a driving force to the second torque limiter 35. The planetary clutch 32 is configured to, when the hook 314 is spaced from the outer gear portion 324C, interrupt transmission of the driving force to the second torque limiter 35.

This configuration uses the planetary clutch 32 to selectively allow or interrupt the transmission of the driving force to the second torque limiter 35.

The switching mechanism 20C of the alternative embodiment includes the pendulum gear 39 movable together with the arm member 38 between the first gear position and the second gear position. When the arm member 38 is at the first arm position, the pendulum gear 39 is at the first gear position to transmit the driving force to the second torque limiter 35. When the arm member 38 is at the second arm position, the pendulum gear 39 is at the second gear position to interrupt the transmission of the driving force to the second torque limiter 35.

This configuration uses the pendulum gear 39 to selectively allow or interrupt the transmission of the driving force to the second torque limiter 35.

In the sheet conveyor, the arm member 31 is pivotable on the rotation axis of the retard roller 23.

As the contact portion 31B of the arm member 31 is located near the nip between the separation roller 22 and the retard roller 23, a nipped sheet S having an increased stiffness may contact the contact portion 31B of the arm member 31, and thus reliably press the arm member 31.

The arm member 38 of the alternative embodiment is pivotable on a rotation axis and includes the first end 38A included in the contact portion 38B, and the second end 38C located opposite to the first end 38A relative to the rotation axis to selectively allow or interrupt the transmission of the driving force to the second torque limiter 35. The arm member 38 has a shape such that a length from the rotation axis to the first end 38A is longer than a length from the rotation axis to the second end 38C.

This configuration uses the principle of the lever, which allows even a soft or floppy sheet S to press the arm member 38.

What is claimed is:

1. A sheet conveyor comprising:

a drive roller configured to convey a sheet in a conveyance direction;

a retard roller forming a nip with the drive roller;

a first torque limiter disposed coaxially with the retard roller and communicating with the retard roller;

a first gear disposed coaxially with the retard roller;

a drive train including a plurality of gears for receiving a driving force from the first gear;

a second torque limiter disposed in the drive train;

a drive transmission member; and an arm member including a contact portion located downstream of the drive roller in the conveyance direction, the arm member being movable between a first arm position in which the arm member engages with the drive transmission member to allow transmission of the driving force to the second torque limiter and a second arm position in which the arm member disengages from the drive transmission member to interrupt transmission of the driving force to the second torque limiter, wherein the arm member is configured to, as the sheet conveyed by the drive roller contacts the contact portion, move from the first arm position to the second arm position.

2. The sheet conveyor according to claim 1, wherein the drive transmission member includes a planetary clutch having an engagement portion, wherein the arm member includes a hook, the hook is engaged with the engagement portion when the arm member is at the first arm position, and the hook is spaced from the engagement portion when the arm member is at the second arm position, and wherein the planetary clutch is configured to, when the hook is engaged with the engagement portion, allow transmission of the driving force to the second torque limiter, and, the planetary clutch is configured to, when the hook is spaced from the engagement portion, interrupt transmission of the driving force to the second torque limiter.

3. The sheet conveyor according to claim 1, further comprising a pendulum gear movable together with the arm member between a first gear position and a second gear position, wherein the pendulum gear is at the first gear position when the arm member is at the first arm position, and the pendulum gear is at the second gear position when the arm member is at the second arm position.

4. The sheet conveyor according to claim 1, wherein the arm member is pivotable about a rotation axis of the retard roller.

5. The sheet conveyor according to claim 1, wherein the arm member is pivotable on a rotation axis and includes a first end included in the contact portion and a second end located opposite to the first end relative to the rotation axis to selectively allow or interrupt the transmission of the driving force to the second torque limiter, and wherein the arm member has a shape such that a length from the rotation axis to the first end is longer than a length from the rotation axis to the second end.

6. An image forming apparatus comprising:

the sheet conveyor according to claim 1; and an image forming unit configured to form an image on a sheet conveyed by the sheet conveyor.

* * * * *